United States Patent [19]

Menchetti

[11] Patent Number: 4,802,321

[45] Date of Patent: Feb. 7, 1989

[54] SAG RESISTANT CEILING PANEL

[75] Inventor: Robert J. Menchetti, Buffalo, N.Y.

[73] Assignee: National Gypsum Company, Dallas, Tex.

[21] Appl. No.: 196,180

[22] Filed: May 18, 1988

[51] Int. Cl.[4] ..... E04B 5/52

[52] U.S. Cl. ..... 52/484; 52/827; 52/828

[58] Field of Search ..... 52/484, 485, 489, 827, 52/828

[56] References Cited

U.S. PATENT DOCUMENTS

| | | | |
|---|---|---|---|
| 1,773,175 | 8/1930 | Edwards | 52/828 |
| 2,549,661 | 4/1951 | Carney | 52/828 X |
| 3,055,466 | 9/1962 | Brown | 52/484 X |
| 4,245,448 | 1/1981 | Agar | 52/489 |
| 4,619,086 | 10/1986 | Naka | 52/484 X |
| 4,640,073 | 2/1987 | Blecher | 52/828 X |
| 4,685,262 | 8/1987 | Meredith, Jr. | 52/484 X |
| 4,702,056 | 10/1987 | Carey | 52/484 |

FOREIGN PATENT DOCUMENTS

| | | | |
|---|---|---|---|
| 572794 | 7/1958 | Belgium | 52/485 |

*Primary Examiner*—David A. Scherbel
*Assistant Examiner*—Lan Mai
*Attorney, Agent, or Firm*—Laird F. Miller; Robert F. Hause

[57] ABSTRACT

A ceiling panel, in a drop ceiling, formed from a relatively large ceiling board and at least one reinforcing metal channel affixed to the board top side, in which the channel has at least one opening shaped to form a tongue. The tongue extends into an opening on a metal plate which is mechanically affixed to the top of the board, such as by a plurality of tangs which penetrate the back of the board.

20 Claims, 4 Drawing Sheets

SAG RESISTANT CEILING PANEL

BACKGROUND OF THE INVENTION

This invention relates to relatively large rigidized thin panels and is particularly directed to edge supported ceiling panels having mechanically attached rigid reinforcing members.

A type of ceiling often referred to as a drop ceiling or a suspending ceiling, in which two-foot square ceiling panels are supported along the panel edges in a steel grid system of main tees and cross tees, has been commonly used for many years.

Attempts to use larger panels to reduce costs and provide novel aesthetics have met with varying degrees of success. One problem that arises with the use of larger panels is the tendency of panels to sag to unacceptable degrees.

U.S. Pat. No. 3,965,639 discloses a stiffener for ceiling tile which is a relatively thin bendable sheet metal strip applied to the back face using adhesives.

SUMMARY OF THE INVENTION

The present invention is directed to overcoming the problem of sagging in ceiling panels, particularly of a size, for example, of about 4-foot square, incorporating a non-bendable reinforcing element, mechanically affixed to the back of a board.

In the preferred embodiments, a metal channel has a section of the web removed from near the middle of the channel. This section of removed material is in a shape which leaves means on the channel web for engaging a metal plate with panel piercing tangs, which plate has been previously affixed to the back of the ceiling panel. The plate is preferably located at about the middle of the panel. In some embodiments the plates are also located at mid points along a pair of opposed sides.

The plates are preferably of the type disclosed in U.S. Pat. No. 4,245,448, wherein plates are disclosed affixed to the back face of gypsum wallboard, for holding the wallboard firmly against metal studs in the wallboard's normal vertical disposition. The present invention contemplates forming an element in the metal channel web, by the above described removal of some material, which element engages the plates of the present invention in a manner similar to the manner in which the suspension clip of U.S. Pat. No. 4,245,448 engages the plates therein.

It is an object of the present invention to provide a novel combination of ceiling panel and means for stiffening of the panel.

It is a further object to provide improved means for stiffening ceiling panels which permit use of the panels with various panel mounting techniques.

It is a still further object of the invention to provide an improved ceiling structure, combining desired distinct aesthetic values with improved performance.

These and other objects and advantages of the invention will be more readily apparent when considered in relation to the preferred embodiments as set forth in the specification and shown in the drawings in which.

DESCRIPTION OF THE PREFERRED EMBODIMENTS

The present invention concerns extra-wide ceiling panels of the lay-in type for drop ceilings. By extra-wide it is meant a panel the width of which exceeds that which is suitably self-supporting and which, without reinforcement, sags during use.

Figure 1:
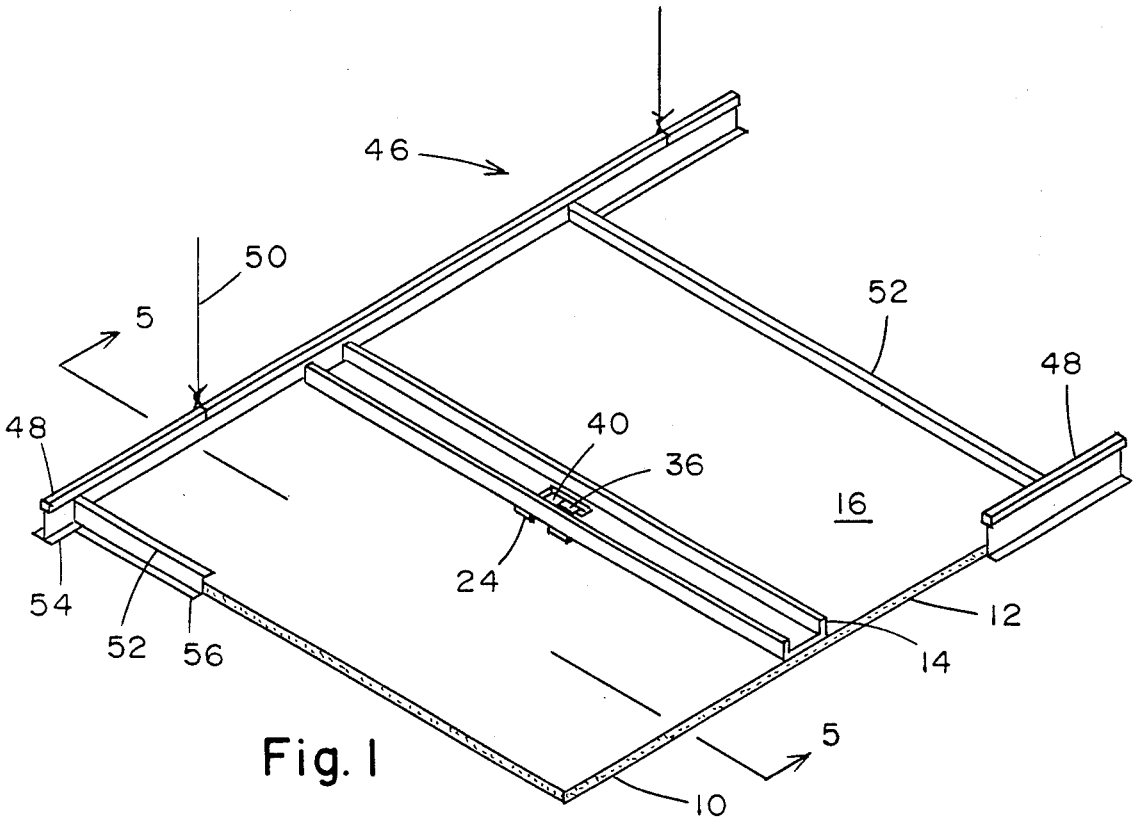
FIG. 1 is an isometric top view of a channel-reinforced ceiling panel mounted within a suspended ceiling grid system, on exposed main tees and exposed cross tees, parts thereof being broken away, such structure being in accordance with the present invention.
Figure 5:
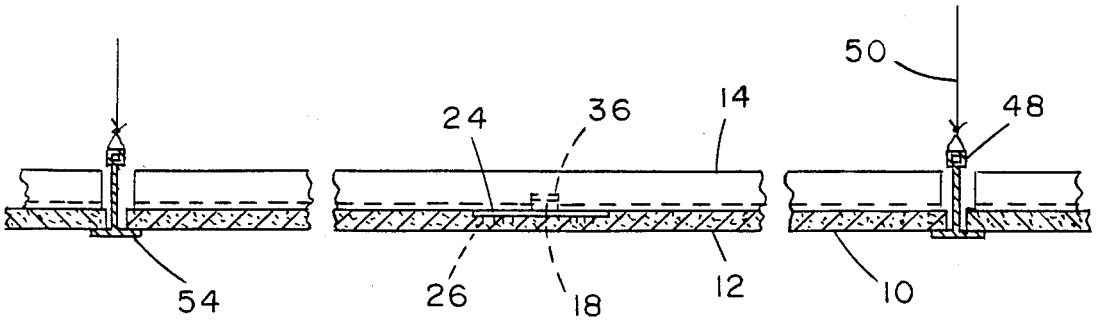
FIG. 5 is an end sectional view of the structure of FIG. 1 taken on line 5—5 thereof.

Referring to FIGS. 1 and 5, there is shown a sag resistant ceiling panel 10, consisting of a four-foot square, ½" thick paper-faced, gypsum board 12 with a four-foot long section of upwardly-opening metal channel 14 mechanically affixed across the middle of the top face 16 of board 12.

Metal channel 14 is affixed to board 12 with a short tongue 18 in the middle of the bottom web 20 of channel 14, which tongue 18 is engaged within a channel or slot 22 of a plate 24. Plate 24, which is constructed similar to the plate of U.S. Pat. No. 4,245,448, the disclosure of which is included herein by reference, has panel piercing tangs 26 which project downwardly, from the main body 28 of plate 24, into the board 12.

The body 28 of plate 24 is rectangular, having a left end portion 30, a right end portion 32 and a neck portion 34 therebetween. The tangs 26 are formed by punching tangs 26 out of the left end portion 30 and the right end portion 32, and bending them to extend substantially perpendicularly downward relative to the body 28 of plate 24. The plate 24 is affixed to the top face 16 of board 12 by driving the board piercing tangs 26 into the top face 16 of board 12.

Within the neck portion 34 there is a channel or slot 22 formed by a partially severed and raised central portion 36 of neck 34, leaving openings 38 at each end of the central portion 36, through which openings 38 the metal channel tongue 18 extends, when the metal channel 14 is affixed to the board 12.

Figure 2:
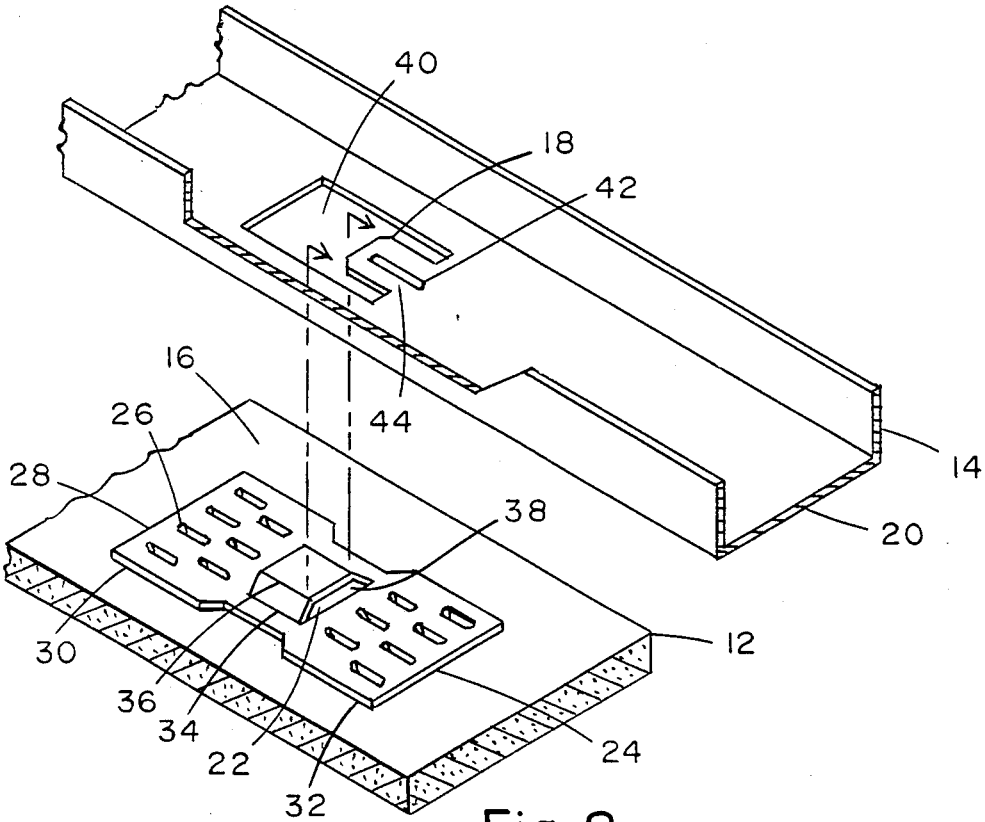
FIG. 2 is an enlarged isometric top view of the center portion of the metal channel of FIG. 1 and of the plate affixed to the ceiling panel, with the channel and the plate disengaged, with broken lines indicating the method for engaging the channel with the plate.

Referring to FIG. 2, the method of affixing metal channel 14 to plate 24 is clearly shown. The structure of the bottom web 20 of metal channel 14 is also more clearly shown. Metal channel 14 has a section of the web 20 removed, from near the middle of the channel 14. The section of the removed material will be seen to be in a shape which forms a relatively large open area 40 and adjacent thereto a short tongue 18 directed axially toward the open area 40. Open area 40 is slightly larger than the raised central portion 36 of plate 24.

To connect the metal channel 14 to the plate 24, the raised central portion 36 of a plate 24, which is affixed to a board 12, is placed within the open area 40 of metal channel 14, with the openings 38 aligned to receive tongue 18. The metal channel 14 is then moved axially to insert the tongue 18 through at least the nearer of the two openings 38, whereby the tongue is held below the raised central portion 36.

Preferably, the channel web 20 includes a short, elongate, axially extending stiffening rib 42, which extends along the centerline of the tongue 18 to within the web 20, beyond the beginning portion 44 of the tongue 18.

Referring again to FIG. 1, the sag resistant ceiling panel 10 is shown mounted in a standard commercial drop ceiling grid system 46. Grid system 46 includes a plurality of spaced parallel elongate main tees 48, which are suspended from suitable supporting wires 50, and a plurality of spaced parallel cross tees 52, which are supported by the main tees 48, in a perpendicular relation thereto. The main tees 48 and cross tees 52 have outwardly extending pairs of flanges 54 and 56, respectively, which support the four edges of each panel 10.

The normal tendency of a four-foot square gypsum board to develop a sag in the center over a period of time, when supported only along the four edges, is overcome in panel 10 by the inclusion of the four-foot long metal channel 14 which is affixed to the board 12 at approximately the center thereof. The channel 14 length is equal to the width of the panel 10, transferring the center load to the flanges 54 of the main tees 48.

Figure 3:
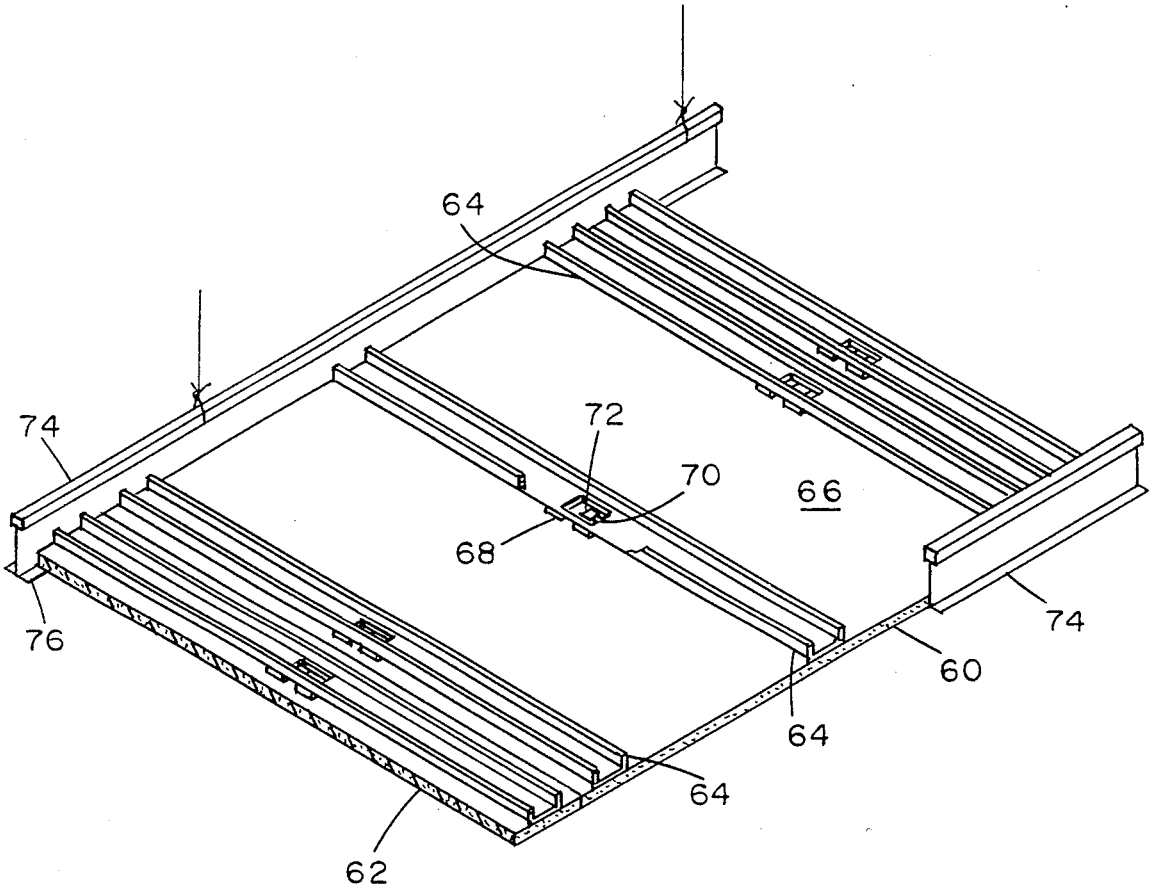
FIG. 3 is an isometric top view of a modified form of the invention wherein additional metal channels are affixed, parallel to the center metal channel, at the panel ends, whereat the additional channels function as concealed cross tees.

In FIG. 3, a modification of the invention is shown in which a modified panel 60, of about four-foot square, consists of a board 62, such as gypsum board or a low density fiber board, and three upwardly opening metal channels 64 affixed to the top face 66 of board 62, each by a tanged plate 68. Channels 64 have tongues 70 which fit under the raised centers 72 of tanged plates 68. One of the three channels 64 is affixed across the center of board 62 and the other two channels 64 are affixed in spaced parallel relation thereto, along edges of the board 62, or spaced closely therefrom.

The panels 60 are supported on spaced parallel main tees 74, extending perpendicular to the extent of the channels 64, and, particularly, on the exposed flanges 76 of the main tees 74. Cross tees are not needed in this embodiment.

Figure 4:
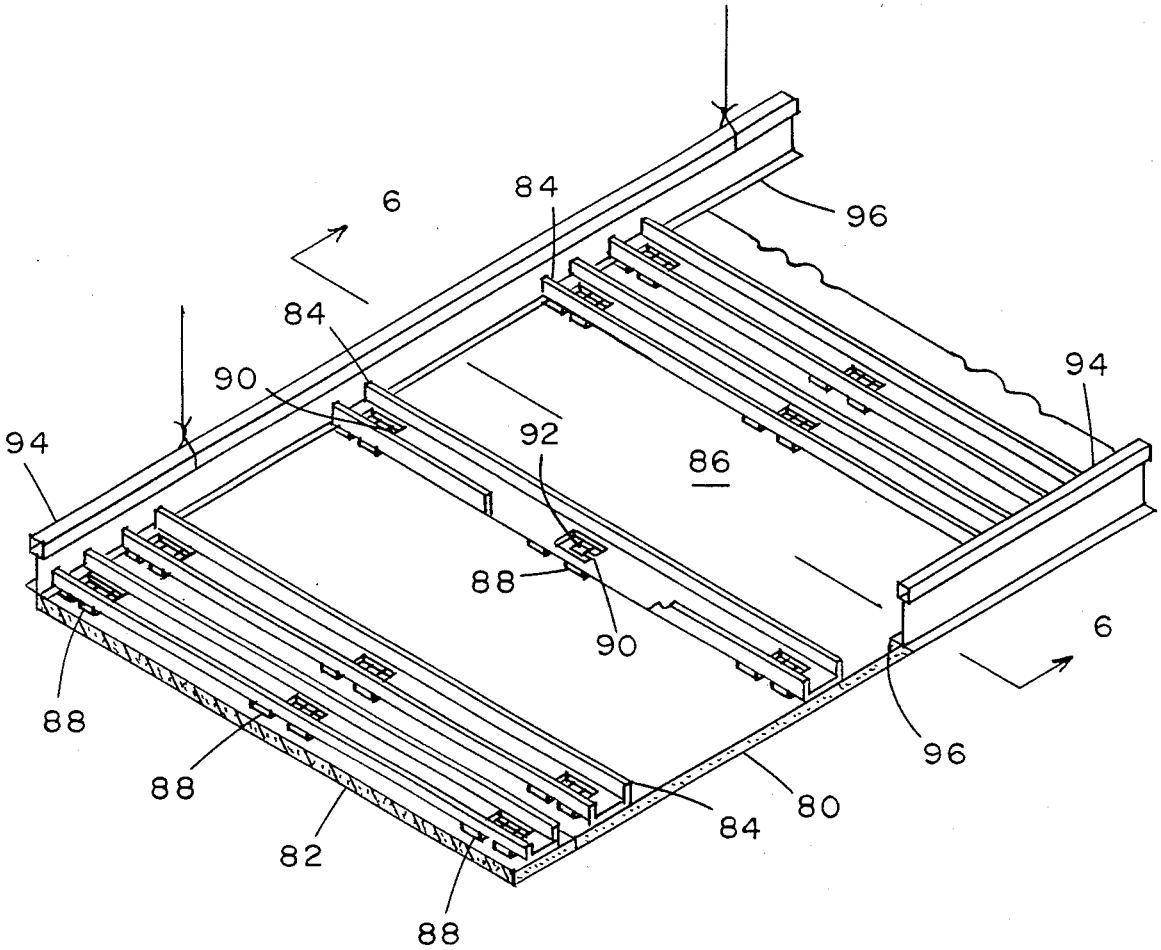
FIG. 4 is an isometric top view of an embodiment of the invention wherein the panels of the embodiment of FIG. 3 have all of the reinforcing channels resting directly on the main tees, providing a ceiling with concealed main tees and concealed cross tees.
Figure 6:
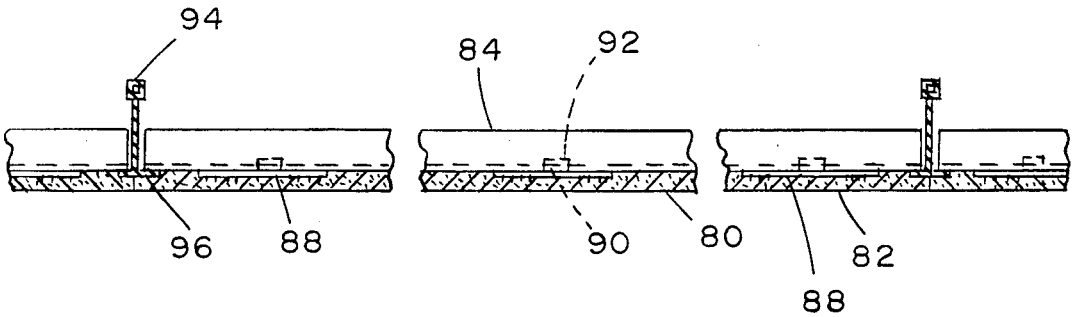
FIG. 6 is an end sectional view of the structure of FIG. 4 taken on line 6—6 thereof.

In FIGS. 4 and 6, a modification of the invention is shown in which a modified panel 80, of about four-foot square, consists of a suitable ceiling board 82 and three upwardly opening metal channels 84 affixed to the top face 86 of board 82, each by three tanged plates 88. Channels 84 each have three tongues 90 which fit under the raised centers 92 of the tanged plated 88 which are affixed to the board top face 86, at three spaced apart locations along the length of each channel 84. One of the channels 84 is affixed across the center of board 82 and the other two channels 84 are affixed in spaced parallel relation thereto, along edges of the board 82, or spaced closely therefrom.

The panels 80 are supported by spaced parallel main tees 94, extending perpendicularly to the extent of the channels 84. In this modification, the main tee flanges 96 are inserted between the board top face 86 and the channels 84, whereby the panels 80 are supported by the channels 84 which rest on the main tee flanges 96. The main tees 94 are thus not exposed to the room below, and cross tees are not needed.

Figure 7:
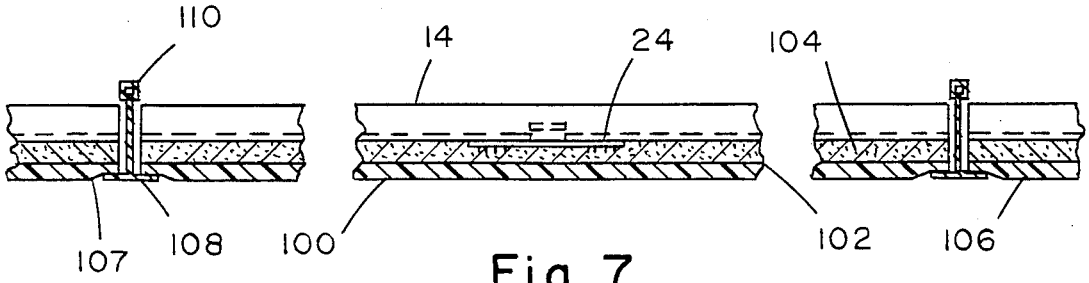
FIG. 7 is an end sectional view of a modified form of the structure of FIG. 5.

In FIG. 7, a modification of the invention is shown in which the structure is similar to the structure of FIG. 5, with the exception that the panel 100 consists of a laminated board 102. The laminated board 102 includes a gypsum board backer 104 and a low density vinyl faced plastic foam facing portion 106. The facing portion 106 has tapered edges 107 which provides recessed joints 108 for partially concealing the main tees 110, the tapered edges 107 resulting from the weight of the relatively large panels 100.

Figure 8:
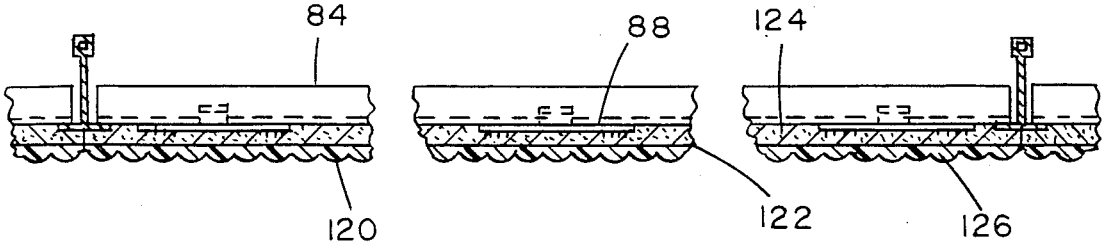
FIG. 8 is an end sectional vie of a modified form of the structure of FIG. 6.

In FIG. 8, a modification of the invention is shown in which the structure is similar to the structure of FIG. 6, with the exception that the panel 120 consists of a laminated board 122. The laminated board 122 includes a gypsum board backer 124 and an embossed low density plastic face ply 126. With the panel 120 supported without the main tees being exposed, the embossed design of the face ply of adjacent panels has a continuous, unbroken appearance.

Figure 9:
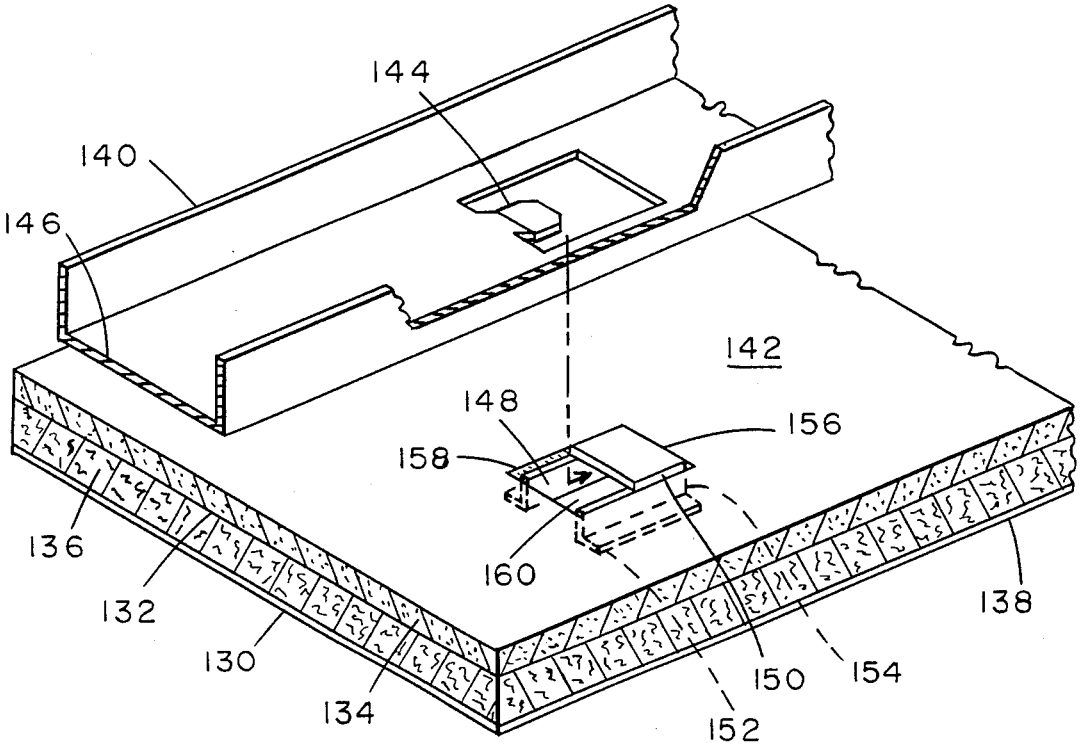
FIG. 9 is an isometric top view of a modified form of the invention wherein the ceiling panel has a built-in clip for attachment to a channel tongue.

In FIG. 9, a modification of the invention is shown in which a sag resistant ceiling panel 130, consists of a four-foot square, 1 inch thick laminated composite 132 of a $\frac{3}{8}$ inch thick rigid gypsum board 134, a $\frac{5}{8}$ inch thick low density, sound absorbing glass fiber board 136 and a decorative porous wrapped fabric facing 138, with a four-foot long section of upwardly-opening metal channel 140 mechanically affixed across the middle of the top face 142 of composite 132.

Metal channel 140 is affixed to composite 132 with a short tongue 144 in the middle of the bottom web 146 of channel 140, which tongue is engaged within a tunnel 148 of clip 150. Clip 150 is constructed of a short section of formed sheet metal having a hat shaped cross section which includes two oppositely outwardly directed bottom flanges 152, two upwardly directed sidewalls 154, and a top wall 156 which extends only throughout about one-half of the length of clip 150. Sidewalls 154 are approximately equal in height to the thickness of gypsum board 134.

The clip 150 is mounted within a rectangular hole 158 cut out of the gypsum board 134, which hole 158 is equal in length to the length of the sidewalls 154 and equal in width to the width of top wall 156. The bottom flanges 152 are disposed between the gypsum board 134 and the fiber board 136, locking the clip 150 in place.

The tongue 144 of web 146 is disposed slightly below the plane of the balance of the web 146, and is engaged within the tunnel 148 formed below top wall 156 by inserting the tongue 144 through an opening 160 created by the absence of any top wall at one end of clip 150, and then moving the channel 140 lengthwise, moving the tongue into tunnel 148.

It is contemplated that the various optional methods of mounting panels shown in FIGS. 3, 4, 6, 7 and 8 can be used by employing a plurality of clips 150 in a plurality of holes 158.

It is further contemplated that the clip 150 can be modified to have slightly taller sidewalls where the sidewalls adjoin the top wall, to permit use of a channel tongue 144 which is formed to be disposed within the same plane as the balance of the web 146 of channel 140. It will then be essential that the opening in the channel web 146 be of a size sufficient to fit around the top wall 156.

Having completed a detailed disclosure of the preferred embodiments of my invention, so that others may practice the same, I contemplate that variations may be made without departing from the essence of the invention.

I claim:

1. A ceiling panel comprising a four-sided extra-wide ceiling board, having a composition which is conductive to developing some sag when supported only along the board edges, said panel further comprising at least one narrow, elongate, rigid reinforcing element, said reinforcing element having a length substantially equal to one of the cross dimensions of said board and being affixed to extend across substantially a full cross dimension of said board, said reinforcing element having a flat rigid web portion disposed against the top face of said board, said flat web portion having an opening therein at approximately the mid point lengthwise of said reinforcing element, said opening having a shape such that a short rigid tongue is formed in said flat web portion, and means on the top face of said board, affixed to said board, in the center portion of said board, for receiving and being supported by said short tongue.

2. A ceiling panel as defined in claim 1 wherein said reinforcing element is an upwardly opening metal channel.

3. A ceiling panel as defined in claim 1 wherein said means for receiving and being supported is a metal plate having a raised portion, said raised portion having an opening formed to receive said short tongue.

4. A ceiling panel as defined in claim 3 wherein said metal plate has a plurality of perpendicularly directed tangs extending downwardly therefrom and penetrating into said board.

5. A ceiling panel as defined in claim 3 wherein said opening includes an open area of a shape suitable for receiving said raised portion during a process of affixing said reinforcing element to said plate.

6. A ceiling panel as defined in claim 5 wherein said plate is rectangular and included a left end portion with a plurality of tangs extending downwardly therefrom, a right end portion with a plurality of tangs extending downwardly therefrom, and a neck portion therebetween, said tangs all penetrating into said board, and said raised portion of said plate being a central portion of said neck portion.

7. A ceiling panel as defined in claim 6 wherein said board is a gypsum board.

8. A ceiling panel as defined in claim 1 wherein said reinforcing element has a short raised rib extending axially thereof and extending into the area of said tongue, providing a stiffening of said tongue.

9. A ceiling panel as defined in claim 1 wherein said board is about four-foot square having only one reinforcing element.

10. A ceiling panel as defined in claim 1 wherein said board is about four-foot square, has three parallel spaced apart narrow, elongate, rigid reinforcing elements each having a short tongue formed in a flat web portion, one of said reinforcing elements being disposed across the center portion of said board and the other two of said reinforcing elements being disposed closely adjacent the two opposite ends of said board, and has at least three means on the top face of said board, affixed to said board, for receiving and being supported by said short tongues.

11. A ceiling panel as defined in claim 10 wherein said three parallel, spaced apart, narrow, elongate, rigid reinforcing elements each have three tongues located respectively at the middle and near each end, and wherein there are three means on the top face of said board, affixed to said board, for each of said three tongues of each of said three reinforcing means.

12. A ceiling panel as defined in claim 10 wherein said reinforcing elements are upwardly opening metal channels, said means for receiving and being supported is a metal plate having a raised portion formed to receive a short tongue and having downwardly projecting board penetrating tangs and said board is a gypsum board.

13. A ceiling panel as defined in claim 1 wherein said panel is a laminated composite and said means for receiving and being supported is a metal clip which is mounted within said composite.

14. A ceiling panel as defined in claim 13 wherein said clip includes a pair of outwardly directed bottom flanges, a pair of upwardly directed sidewalls and a partial top wall, said flanges and sidewalls being disposed with a hole in a top ply of said laminated composite.

15. A ceiling panel as defined in claim 14 wherein said opening includes an open area of a shape suitable for receiving said partial top wall.

16. A drop ceiling comprising a plurality of parallel, spaced apart elongate, wire supported main tees, and a plurality of ceiling panels as defined in claim 1, said ceiling panels being supported, to form a horizontal ceiling, by said main tees.

17. A drop ceiling as defined in claim 13, further comprising a plurality of spaced apart, parallel cross tees, said main tees and said cross tees having outwardly extending bottom flanges, said boards having edges, all of which said edges are disposed and supported on said flanges.

18. A drop ceiling as defined in claim 13 wherein said plurality of ceiling panels have said narrow, elongate, rigid reinforcing elements supported directly on said main tees.

19. A laminated panel comprising means for supporting said panel, said panel having at least two layers of material affixed together in a laminated relationship, at least one of said layers having a small hole extending therethrough, said panel having a metal clip disposed within said hole, said metal clip having a top wall which extends throughout only a portion of the area of said hole, said metal clip forming a tunnel below said top wall, said tunnel being accessible for insertion of panel supporting means, whereby said panel can be at least partially supported by means insertable into said clip.

20. A laminated panel as defined in claim 19 wherein said small hole is rectangular and said metal clip is of hat shaped cross section including two oppositely outwardly directed bottom flanges, two upwardly directed sidewalls and a top wall which extends only throughout about one-half of the length of said clip, said sidewalls are approximately equal in height to the thickness of said layer of material having a small hole therethrough, said hole is about equal in length with the length of said sidewalls and equal in width to the width of said top wall, and said bottom flanges are disposed between two of said layers of material.

* * * * *

UNITED STATES PATENT AND TRADEMARK OFFICE

CERTIFICATE OF CORRECTION

PATENT NO. : 4,802,321

DATED : February 7, 1989

INVENTOR(S) : Robert J. Menchetti

It is certified that error appears in the above-identified patent and that said Letters Patent is hereby corrected as shown below:

Column 6, line 34, "13" should read -- 16 --.

Column 6, line 40, "13" should read -- 16 --.

Column 5, line 42, "included" should read -- includes --.

Signed and Sealed this

First Day of August, 1989

*Attest:*

*Attesting Officer*

DONALD J. QUIGG

*Commissioner of Patents and Trademarks*